US008256051B2

(12) United States Patent
McAllister et al.

(10) Patent No.: US 8,256,051 B2
(45) Date of Patent: Sep. 4, 2012

(54) RANDOM TUMBLING WASHING MACHINE WASH CHAMBER FOR IMPROVING CLEANING WHILE MINIMIZING MECHANICAL DAMAGE TO CLOTHES

(75) Inventors: Karl David McAllister, Stevensville, MI (US); Andrew J. Leitert, Eau Claire, MI (US); Daniel C. Conrad, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 12/710,612

(22) Filed: Feb. 23, 2010

(65) Prior Publication Data

US 2010/0146714 A1 Jun. 17, 2010

Related U.S. Application Data

(60) Division of application No. 10/766,404, filed on Jan. 27, 2004, now Pat. No. 7,690,063, which is a continuation-in-part of application No. 10/142,345, filed on May 9, 2002, now Pat. No. 7,127,767.

(51) Int. Cl.
*D06F 33/00* (2006.01)
*D06F 21/00* (2006.01)

(52) U.S. Cl. ..... 8/159

(58) Field of Classification Search ..... 68/171–174, 68/12.02, 12.16, 23.7, 131–133; 8/158–159
See application file for complete search history.

(56) References Cited

U.S. PATENT DOCUMENTS

| | | | | |
|---|---|---|---|---|
| 2,234,836 | A * | 3/1941 | Vick | 74/70 |
| 2,438,273 | A * | 3/1948 | Easters | 68/152 |
| 2,453,707 | A * | 11/1948 | Graham | 68/12.01 |
| 2,645,111 | A * | 7/1953 | Fields | 68/23.6 |
| 2,823,975 | A * | 2/1958 | Kirby | 8/159 |
| 3,248,908 | A * | 5/1966 | Pope | 68/12.16 |
| 4,325,234 | A * | 4/1982 | Toma | 68/133 |
| 5,031,427 | A | 7/1991 | Pastryk et al. | |
| 5,219,370 | A | 6/1993 | Farrington et al. | |
| 5,341,452 | A * | 8/1994 | Ensor | 388/811 |
| 5,460,018 | A | 10/1995 | Werner et al. | |
| 5,504,955 | A * | 4/1996 | Mueller et al. | 8/158 |
| 5,507,053 | A * | 4/1996 | Mueller et al. | 8/158 |
| 5,546,772 | A | 8/1996 | Merlin et al. | |
| 5,560,061 | A * | 10/1996 | Wentzlaff et al. | 8/159 |
| 5,791,167 | A * | 8/1998 | Wyatt et al. | 68/134 |
| 5,974,610 | A | 11/1999 | Johnson et al. | |
| 6,868,573 | B2 * | 3/2005 | Rohl et al. | 8/159 |
| 6,886,372 | B2 * | 5/2005 | Kropf | 68/134 |

* cited by examiner

*Primary Examiner* — Joseph L Perrin
(74) *Attorney, Agent, or Firm* — Clifton G. Green; Greer, Burns & Crain Ltd

(57) ABSTRACT

Methods and apparatuses consistent with the present invention provide for improved cleaning while minimizing mechanical damage to clothes in automatic washer cycles using time-varying wash chamber oscillations. An automatic washer has a wash chamber with a central axis and is rotatable about the central axis. Items are loaded into the wash chamber. Wash liquid is supplied into the wash chamber. The wash chamber is oscillated about the central axis by time-varying oscillations.

11 Claims, 7 Drawing Sheets

| | CW RPM (RPM) | CCW RPM (RPM) | CW ON TIME (SECONDS) | CW OFF TIME (SECONDS) | CCW ON TIME (SECONDS) | CCW OFF TIME (SECONDS) |
|---|---|---|---|---|---|---|
| FULL RANDOM A | 50 - 90 | 50 - 90 | 0.135 - 2.0 | 0.135 - 2.0 | 0.135 - 2.0 | 0.135 - 2.0 |
| FULL RANDOM B | 30 - 75 | 30 - 75 | 0.135 - 1.0 | 0.135 - 1.0 | 0.135 - 1.0 | 0.135 - 1.0 |

| | CW RPM (RPM) | CCW RPM (RPM) | CW DEG SWING (DEGREES) | CW OFF TIME (SECONDS) | CCW DEG SWING (DEGREES) | CCW OFF TIME (SECONDS) |
|---|---|---|---|---|---|---|
| DEGREE RANDOM A | 30 - 100 | 30 - 100 | 180 | 0.1 - 1.0 | 180 | 0.1 - 1.0 |
| DEGREE RANDOM B | 20 - 60 | 20 - 60 | 240 | 0.135 - 1.0 | 240 | 0.135 - 1.0 |

| | CW RPM (RPM) | CCW RPM (RPM) | RPM CHANGE (SECONDS) | CW DEG SWING (DEGREES) | CW OFF TIME (SECONDS) | CCW DEG SWING (DEGREES) | CCW OFF TIME (SECONDS) |
|---|---|---|---|---|---|---|---|
| RATCHET RANDOM | 50 +/- 30 | 50 +/- 30 | 0.3 | 360 | 0.5 | 360 | 0.5 |

| | CCW | CW |
|---|---|---|
| RPM MEAN (RPM) | 70 | 70 |
| RPM RANGE (RPM) | +/- 20 | +/- 20 |
| TORQUE (NM) | 39 | 39 |
| ON TIME (SEC) | 0.3 - 0.5 | 0.3 - 0.5 |
| OFF TIME (SEC) | 0 - 0.3 | 0 - 0.3 |

| | CCW | CW |
|---|---|---|
| RPM MEAN (RPM) | 70 | 90 |
| RPM RANGE (RPM) | +/- 10 | +/- 20 |
| TORQUE (NM) | 39 | 44 |
| ON TIME (SEC) | 0.3 - 0.5 | 0.3 - 0.5 |
| OFF TIME (SEC) | 0.05 | 0 - 0.3 |

*FIG. 11*

| | CW RPM (RPM) | CCW RPM (RPM) | CW ON TIME (SECONDS) | CW OFF TIME (SECONDS) | CCW ON TIME (SECONDS) | CCW OFF TIME (SECONDS) |
|---|---|---|---|---|---|---|
| FULL RANDOM A | 50 - 90 | 50 - 90 | 0.135 - 2.0 | 0.135 - 2.0 | 0.135 - 2.0 | 0.135 - 2.0 |
| FULL RANDOM B | 30 - 75 | 30 - 75 | 0.135 - 1.0 | 0.135 - 1.0 | 0.135 - 1.0 | 0.135 - 1.0 |

| | CW RPM (RPM) | CCW RPM (RPM) | CW DEG SWING (DEGREES) | CW OFF TIME (SECONDS) | CCW DEG SWING (DEGREES) | CCW OFF TIME (SECONDS) |
|---|---|---|---|---|---|---|
| DEGREE RANDOM A | 30 - 100 | 30 - 100 | 180 | 0.1 - 1.0 | 180 | 0.1 - 1.0 |
| DEGREE RANDOM B | 20 - 60 | 20 - 60 | 240 | 0.135 - 1.0 | 240 | 0.135 - 1.0 |

| | CW RPM (RPM) | CCW RPM (RPM) | RPM CHANGE (SECONDS) | CW DEG SWING (DEGREES) | CW OFF TIME (SECONDS) | CCW DEG SWING (DEGREES) | CCW OFF TIME (SECONDS) |
|---|---|---|---|---|---|---|---|
| RATCHET RANDOM | 50 +/- 30 | 50 +/- 30 | 0.3 | 360 | 0.5 | 360 | 0.5 |

RANDOM TUMBLING WASHING MACHINE WASH CHAMBER FOR IMPROVING CLEANING WHILE MINIMIZING MECHANICAL DAMAGE TO CLOTHES

CROSS-REFERENCE TO RELATED APPLICATION

This application is a division of U.S. application Ser. No. 10/766,404 filed Jan. 27, 2004, which is a continuation-in-part of U.S. application Ser. No. 10/142,345 filed May 9, 2002, now U.S. Pat. No. 7,127,767.

BACKGROUND OF THE INVENTION

The present invention relates to washing machines and more particularly to moving clothes within the wash chamber of an automatic washer.

Known washing machines include vertical axis washers that use an agitator, impeller or some other type of rotor that rotates or oscillates about a vertical axis, such as shown in U.S. Pat. Nos. 5,031,427 and 5,460,018 or horizontal axis machines that input mechanical energy to the clothes load by rotating the wash chamber at a speed less than that which could cause the clothes to be held against the wall of the wash chamber by centrifugal force. Such horizontal axis machines are disclosed in U.S. Pat. Nos. 5,219,370 and 5,974,610.

In such typical horizontal or tilted axis washing machines, the wash chamber rotations or oscillations are symmetric and constant during the majority of a wash cycle. That is, they use a set, non-changing clockwise and counter clockwise wash chamber oscillation. In a vertical axis machine, typically there is a center rotor in the form of an agitator or impeller that rotates to impart mechanical energy to the wash load, and typically those rotations are symmetric and constant during the majority of the wash cycle. The wash chamber may be rotatable, but typically the wash chamber is rotated only during an extraction mode when it is desired to remove water or wash liquid from the clothes load, and then the wash chamber is spun in one direction only.

FIG. 1 depicts a typical symmetrical wash chamber oscillation period during a typical wash cycle in a horizontal or tilted axis washer. In FIG. 1, signals above the horizontal time axis indicate a clockwise rotation signal, signals along the time axis indicate no rotation signal (motor off) or a pause, and signals below the time axis indicate a counter-clockwise rotation signal. The illustrated oscillation period includes a 0.5 second clockwise (motor on) time, followed by a 0.5 second pause (motor off), followed by a reversing 0.5 second counter-clockwise (motor on) time, followed by a 0.5 second pause (motor off). The oscillations are constant, in that the period is then repeated. In some horizontal axis machines, the oscillation cycles may be longer or shorter, such as an 8 second clockwise rotation, 8 second pause, 8 second counter clockwise rotation and 8 second pause. A more complex pattern may also be provided, such as an 8 second clockwise rotation, 2 second pause, 8 second counter clockwise rotation and 2 second pause. However, whatever the individual pattern is for a given period, it is this same pattern that is repeated for all periods.

In U.S. Ser. No. 10/142,345, assigned to Whirlpool Corporation, assignee of the present application, the washer oscillates the clothes load for a plurality of periods of clockwise and counter-clockwise oscillations, wherein the time duration of the oscillations are selected for each period. The oscillations can be symmetrical or asymmetrical, and can have a time duration that is variable. Further, in another embodiment, the time duration of the oscillations varies for consecutive periods.

The tumbling action of the clothes load in a washer results in a flexing of the fabric to loosen and remove dirt and other foreign materials from the fabric load, but it also causes mechanical damage to the fabric in the form of broken threads. A reduction in such damage would be desirable, particularly if the level of dirt and foreign material removal can be maintained or enhanced.

SUMMARY OF THE INVENTION

According to the present invention, therefore, methods and apparatuses are provided for maintaining or enhancing the dirt and foreign material removal in a fabric load, while reducing the mechanical damage to the fabric inside a washing machine having a rotatable wash chamber by using randomly selected symmetric or asymmetric clockwise and counter-clockwise wash chamber oscillations that vary in subsequent periods. Conversely, the level of mechanical damage to the fabric may remain the same as in conventional washers while greatly enhancing dirt and foreign material removal. A period is defined as beginning at the onset of a stroke in a first direction and ending at the termination of the opposite direction stroke, the combination of strokes comprising an oscillation. These oscillations reduce the mechanical damage to clothes while improving the cleaning effect of the wash cycle. The stroke speed may vary randomly, the stroke angle, or the angle traversed may vary randomly, and the off time or pause between strokes or oscillations may vary randomly. Stroke speed or angle of a counterclockwise stroke may vary from the stroke speed or angle of a clockwise stroke within a single oscillation. These strokes or oscillations may vary randomly with each subsequent period.

In accordance with methods consistent with the present invention, a method of washing items in an automatic washer is provided, wherein the automatic washer has a wash chamber with a central axis and the wash chamber being rotatable about the central axis. The method comprises the steps of loading items into the wash chamber, supplying wash liquid into the wash chamber, and oscillating the wash chamber about the central axis by speed varying, range varying, off-time varying, ontime varying, or combination thereof, oscillations. The oscillations can comprise rotational movement exceeding a full revolution, or being less than a full revolution.

In an embodiment, the wash chamber oscillates for a plurality of periods of clockwise and counter-clockwise oscillations, wherein the time duration of the speed and time duration of the strokes are selected for each period. The strokes can be symmetrical or asymmetrical, and can have a speed or time duration that is selected randomly or from some predetermined varying pattern. Further, in another embodiment, the time duration of the oscillations vary for consecutive periods. The average or mean speed or time of the time-varying oscillations can be adjusted by the controller responsive to an amount of the items, to a size of the items, or a cloth type (i.e. silk vs. denim).

The items in the wash chamber can move, for example, in a tumbling pattern.

In accordance with apparatuses consistent with the present invention, an automatic washer is provided. The automatic washer comprises a cabinet, a wash chamber with a central axis supported within the cabinet, a motor suspended outside the wash chamber and drivingly connected to the wash chamber, the wash chamber oscillating about the central axis by speed- and time-varying oscillations. The wash chamber may have a horizontal axis or any non-vertical axis. The automatic washer may use aqueous wash liquid, conventional non-aqueous fluids known as dry cleaning fluids, other non-aqueous fluids, some combination of the foregoing or no wash liquid or fluid.

The above-mentioned and other features, utilities, and advantages of the invention will become apparent from the following detailed description of the preferred embodiments of the invention together with the accompanying drawings.

Other systems, methods, features, and advantages of the invention will become apparent to one with skill in the art upon examination of the following figures and detailed description. It is intended that all such additional systems, methods, features, and advantages be included within this description, be within the scope of the invention, and be protected by the accompanying drawings.

BRIEF DESCRIPTION OF THE DRAWING

The accompanying drawings, which are incorporated in and constitute a part of this specification, illustrate an implementation of the invention and, together with the description, serve to explain the advantages and principles of the invention.

FIG. 11 depicts Full Random, Degree Random and Ratchet Random wash profiles.

DETAILED DESCRIPTION OF THE PREFERRED EMBODIMENT

In accordance with methods and apparatuses consistent with the present invention, in some embodiments of the invention, the mechanical action inside a washing machine having a wash chamber rotatable about an axis is enhanced by using symmetric clockwise and counter-clockwise wash chamber oscillations that vary with each subsequent period. In other embodiments, the oscillations may be non-symmetric or may vary over time, and not with each subsequent period. In some embodiments, the oscillation periods may be randomly selected, while in other embodiments, the oscillation periods may be selected in accordance with a predetermined pattern.

Within each oscillation, as defined herein, are a series or sequence of steps or actions. There is a stroke in a first direction, followed by a pause, then a stroke in a second direction followed by a second pause. As contemplated in the present invention, each of the aforementioned steps or actions may be randomly selected or may be selected in accordance with a predetermined pattern, within certain preselected ranges of speeds, times or stroke angles.

Methods and apparatuses consistent with the present invention may be embodied in any type of automatic washer in which the wash chamber is oscillated to provide the mechanical energy input to the clothes load, for example, a horizontal axis washer or a nonvertical axis washer. Similarly, methods and apparatuses consistent with the present invention be embodied in a vertical axis machine. In a vertical axis machine, typically there is a center rotor in the form of an agitator or impeller that rotates to impart mechanical energy to the wash load. Some types of vertical axis washers may also use the wash chamber itself, or rotors or other protrusions extending into the wash chamber therefrom, as the mechanism for imputing mechanical energy into the clothes load, as opposed to a separately rotatable agitator, impeller or other rotor, and the present invention can be utilized and realized in such vertical axis washers.

Figure 2:
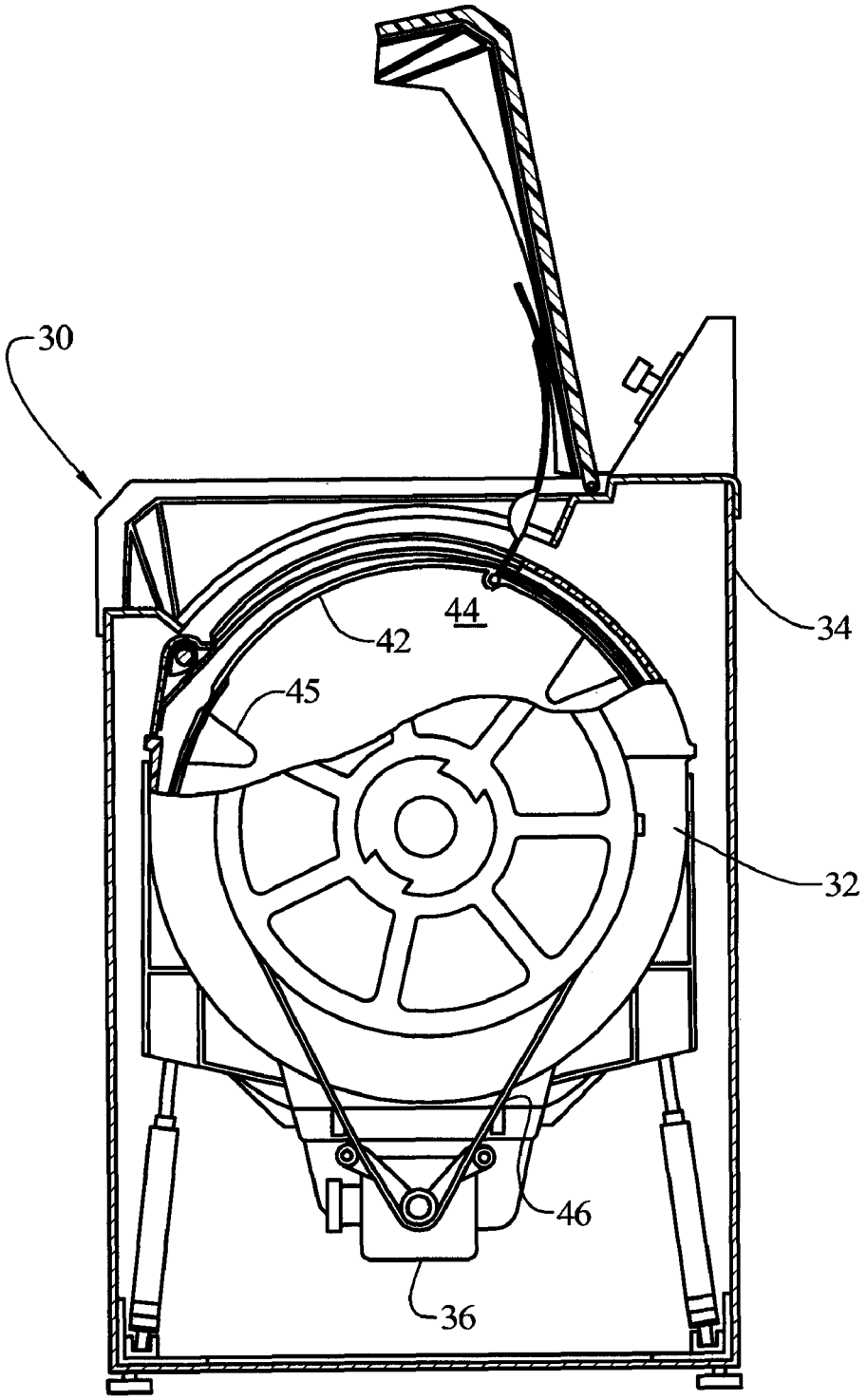
FIG. 2 depicts a side sectional view of a washing machine constructed and operated in accordance with the present invention.
Figure 3:
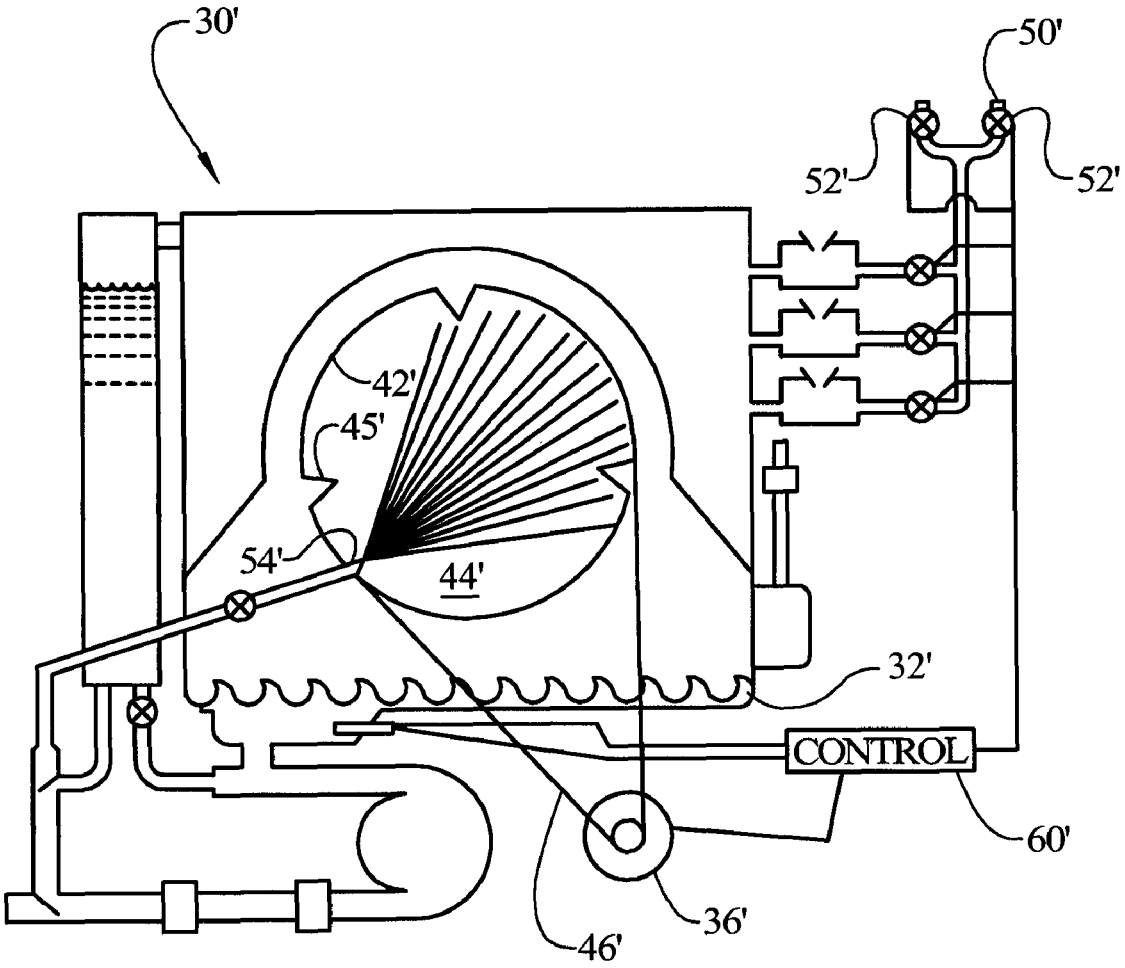
FIG. 3 depicts a side sectional view of another washing machine constructed and operated in accordance with the present invention.

In an example, methods and apparatuses consistent with the present invention may be embodied, in an automatic washer as depicted in FIG. 2. FIG. 2 illustrates an automatic washer 30 such as that disclosed in U.S. Pat. No. 5,546,772, which is incorporated herein by reference. The structure and operation of such a washer is described in greater detail in that patent. FIG. 3 illustrates an automatic washer 30', such as that disclosed in U.S. Pat. No. 5,219,370, which is incorporated herein by reference. The structure and operation of that washer, which has a front opening door providing access to the horizontal axis wash chamber, may also be utilized with the present invention. The following description of the operation relates to both of the illustrated embodiments and would also pertain to washers of other known constructions, including vertical axis and nonvertical axis washers. In an embodiment, the invention is embodied in a washer in which the wash chamber is rotatable about an axis that is non-vertical; that is, the axis of rotation is angled from vertical by at least 20 degrees.

The washer 30 of FIG. 2, and the washer 30' of FIG. 3, include an outer tub 32, 32' which is disposed and supported within a cabinet structure 34. A motor 36, 36' is provided for rotatably driving a wash basket 42, 42' which encloses a wash chamber 44, 44'. In an embodiment, the motor 36, 36' is a reversible motor. In other embodiments, a reversible transmission may be used. The wash basket may include one or more inwardly directed protrusions 45, 45' for engaging clothes during the wash process to assist in imparting mechanical energy to the clothes load. The wash basket 42, 42' is rotatably supported within the tub 32, 32'. Drive power is transmitted from the motor 36, 36' to the wash basket 42, 42' via a belt 46, 46'. Alternatively, the present invention could be employed in an automatic washer which employs a direct drive type power transmission system.

As shown specifically in the schematic illustration of FIG. 3, but pertainable to all washer constructions, during periods of the automatic washer operation, water is supplied into the automatic washer 30' from an external source 50'. Preferably, both a hot water and cold water supply is fluidly connected to the automatic washer 30'. A flow valve 52', controls the inlet of wash liquid into the washer 30'. Wash liquid is sprayed into the wash basket 42' through an inlet nozzle 54'. A controller 60', which may be in the form of an electronic controller, controls the operation of the washer in accordance with the present invention. Controller 60' is operatively connected to the motor 44' and the flow valve 52'. Controller 60' provides an oscillation signal (e.g., an on/off or variable speed signal) to the motor 44' for inducing the wash basket 42', and hence the wash chamber 44' to rotate.

As used herein, the term oscillate, as related to wash basket or wash chamber motion, describes motion wherein the wash basket or wash chamber is alternately rotated in a first direction and then in a reverse direction. The wash basket and wash chamber may complete one or many full revolutions, or less than one full revolution, while rotating or spinning in one direction before being reversed to rotate in the opposite direction.

In accordance with methods and apparatuses consistent with the present invention, the mechanical action inside the automatic washer 30, 30' is enhanced in some embodiments by using symmetric clockwise and counter-clockwise wash chamber oscillations that vary with each subsequent oscillation period. In other embodiments, the oscillations may vary over time, but not necessarily with each successive period. For example, two to ten periods in a row may have the same oscillation before a change is made. Further, as will be described in more detail below, in an embodiment, the variation of the oscillations can be bi-modal, that is, limited to two selected period lengths, switching between these two lengths after every third or more period.

Figure 4:
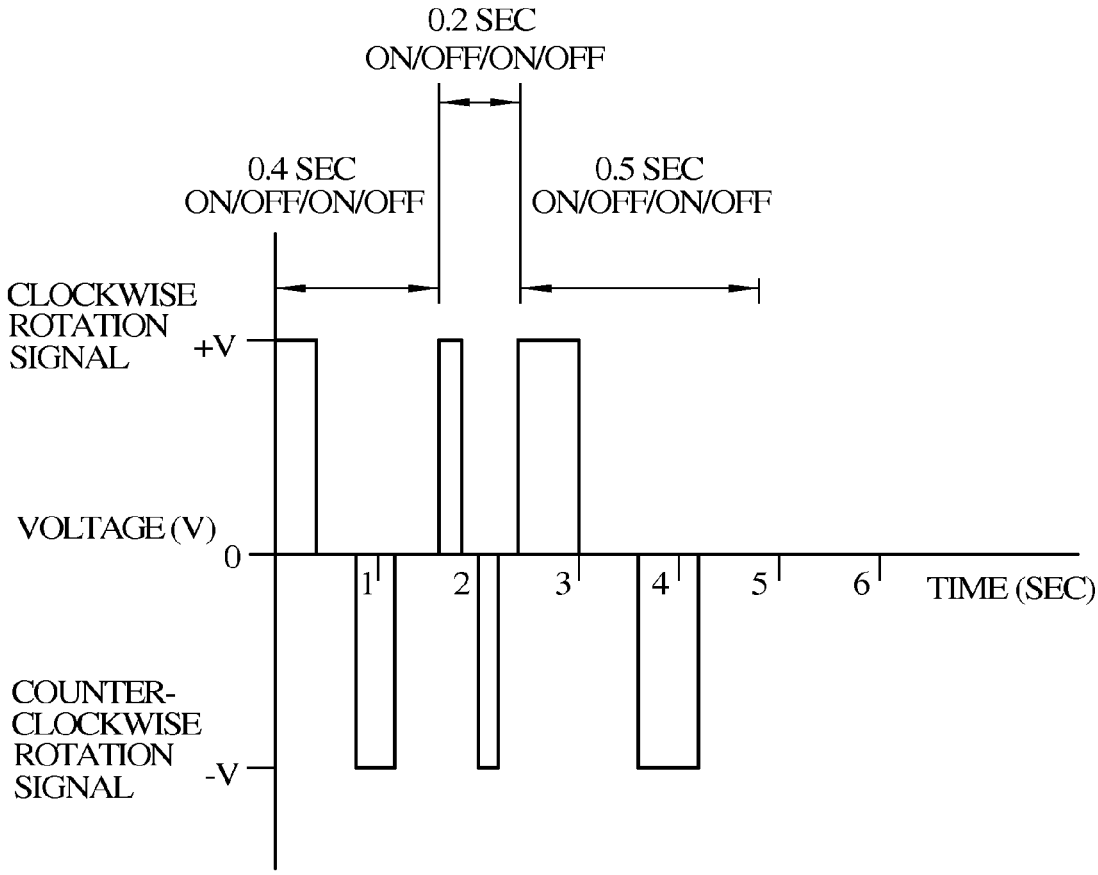
FIG. 4 depicts a timing diagram of symmetrical motor oscillations that vary with each subsequent period in accordance with the present invention.

FIG. 4 depicts symmetrical motor oscillations that vary with each subsequent period in accordance with the present invention. As shown in FIG. 4, the first random impeller oscillation time is 0.4 seconds. This value is used during one oscillation period: 0.4 seconds clockwise (motor on) time, 0.4 seconds pause (motor off), 0.4 seconds counter-clockwise (motor on) time, and 0.4 seconds pause (motor off). Once the period is complete, a second "random" value, which may be different than the first random value of 0.4 seconds, is used. In the illustrative example, 0.2 seconds is used for the next oscillation period. Once this second oscillation period is complete, a value of 0.5 seconds is used for the next oscillation period. In the illustrative example depicted in FIG. 4, the impeller oscillation times range from 0.2 to 0.5 seconds. The oscillation times can be set to a greater number of discrete values than shown in FIG. 4. Also, other oscillation times in the range from 0.2 to 0.5 seconds can be used, such as oscillation times of 0.222 and 0.369 seconds. Randomly varying the oscillation time between the limits, with each subsequent period, yields a distribution of oscillation times. Alternatively to a random variation could be a predetermined variation within a given range of oscillation times to achieve a desired mean time for the oscillations. Random variation could also include predetermined variations according to some parameter or equation other than mean time. Therefore, such "random" variations which could be obtained or selected in a number of ways could be used to obtain various desired results.

In the illustrative example of FIG. 4, the impeller oscillation times range from 0.2 to 0.5 seconds, however, the upper and lower oscillation time limits are not limited thereto. The oscillations times can be lower than 0.2 seconds and can be greater than 0.5 seconds.

The controller 60' can receive an input from a user to adjust the oscillation time based on, for example, the load size or the number of items in the load. The controller is provided with, for example, a keypad or operators for this purpose. Using the keypad, the user, for example, selects a small, medium, or large load size or a small, medium, or large item size. The controller 60' can proportionally adjust the oscillation time based on the received user input, such as proportionally to load size or item size. Alternatively, the controller 60' can increase or decrease the variation of the oscillation time based on the load size or item size. Instead of or in conjunction with a user-controlled load setting, the washer may detect or sense the load size or item size using known load detection techniques. For example, the controller 60' can provide oscillation signals having lower average means times for small loads than for large loads.

Figure 5:
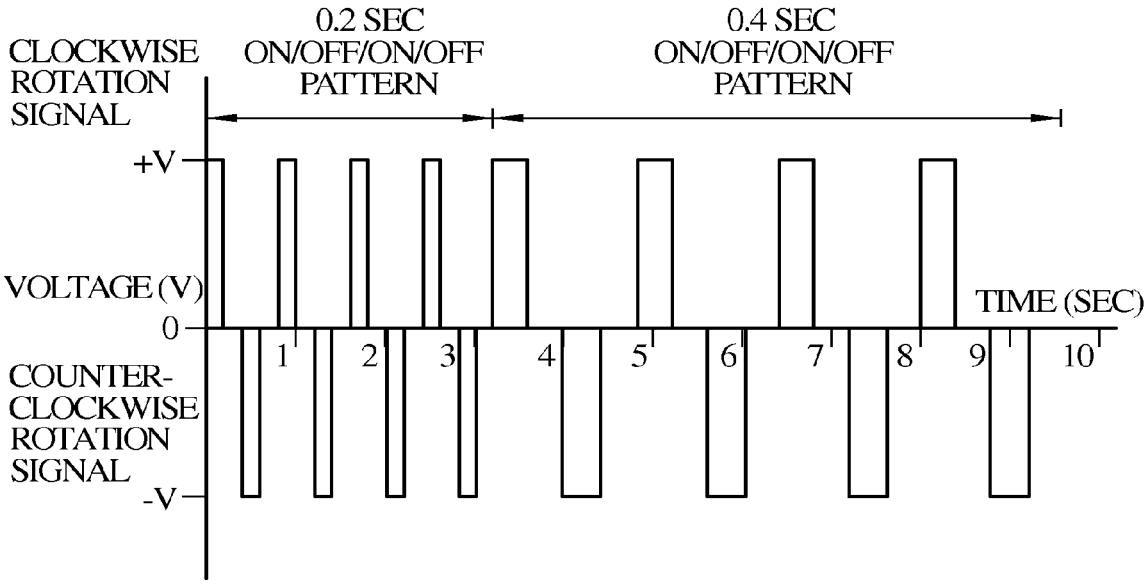
FIG. 5 depicts a timing diagram of symmetrical motor oscillations that vary with each fourth period in accordance with the present invention.

FIG. 5 depicts a timing diagram of an illustrative "bi-modal stroke" profile. In a "bi-modal stroke" profile, symmetrical impeller oscillations having a first time value (e.g., 0.2 seconds) repeat for a first predetermined number of oscillation periods (e.g., 4 oscillation periods), then symmetrical impeller oscillations having a different time value (e.g., 0.4 seconds) repeat for a second predetermined number of oscillation periods (e.g., 6 oscillation periods), then the entire impeller oscillation sequence is repeated. As shown in FIG. 5, the illustrative values are 0.2-second impeller oscillations, repeated for a total of four oscillation periods, followed by 0.4-second impeller oscillations, repeated for a total of four oscillation periods. The entire impeller oscillation sequence is then repeated. Alternatively, the duration of the oscillations and the number of periods used can be different values. For example, the first oscillation time value can be 0.211 seconds, with the oscillations repeating for three periods, followed by a 0.455-second oscillation for seven periods.

Figure 1:
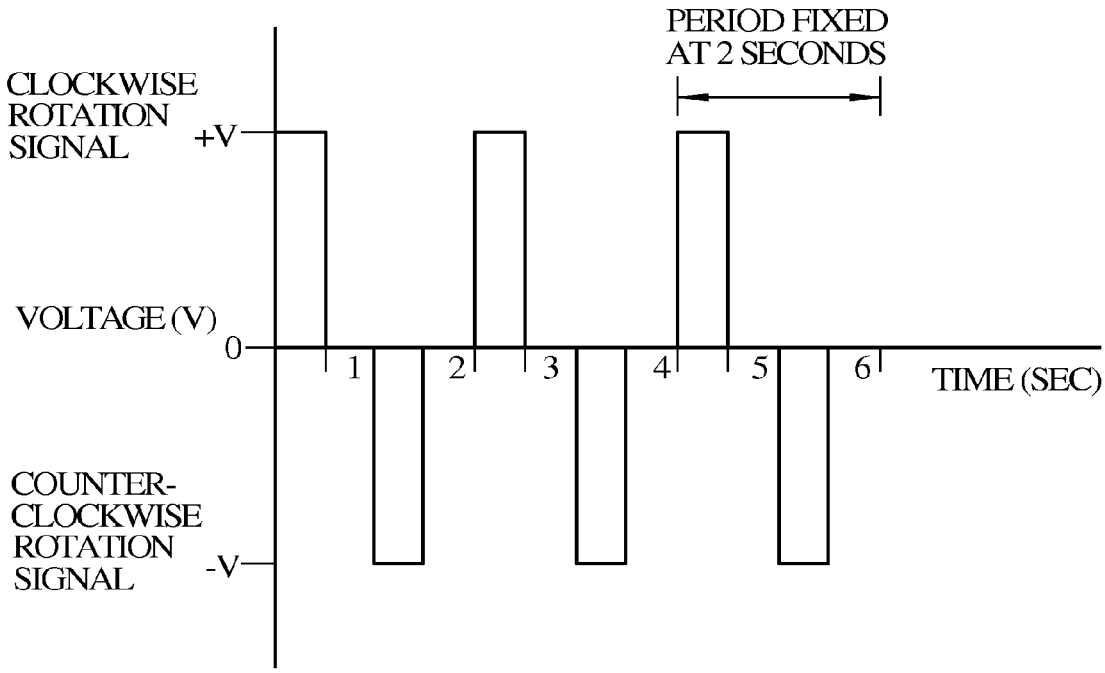
FIG. 1 PRIOR ART
FIG. 1 depicts a timing diagram of typical symmetrical motor oscillations that are constant for all periods.
Figure 6:
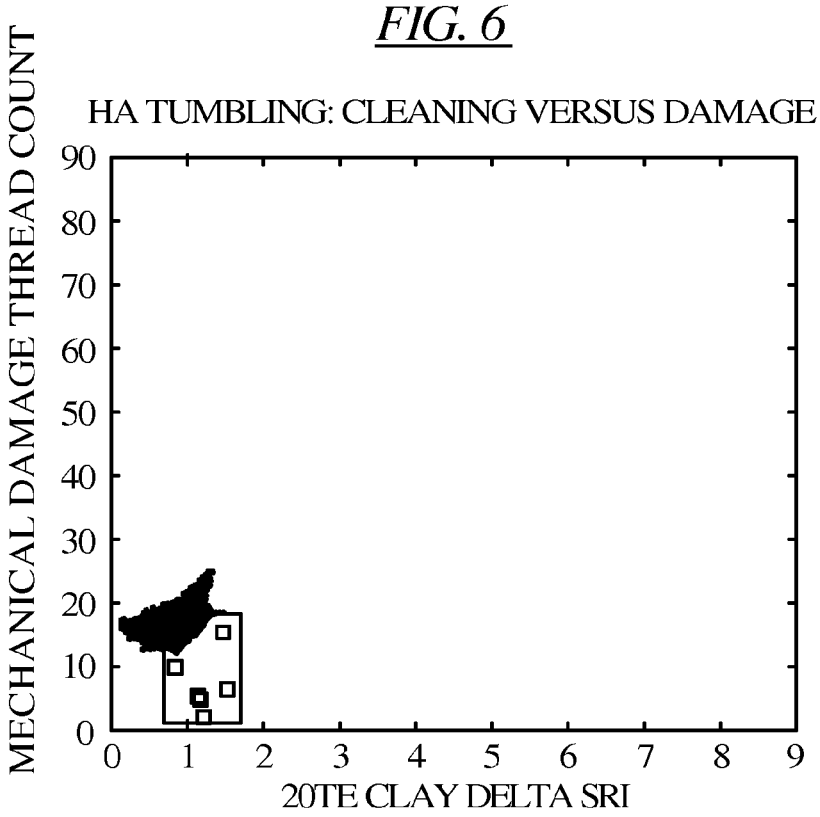
FIG. 6 illustrates experimental results of the cleaning results versus mechanical damage in a washing machine embodying the principles of the present invention.
Figure 7:
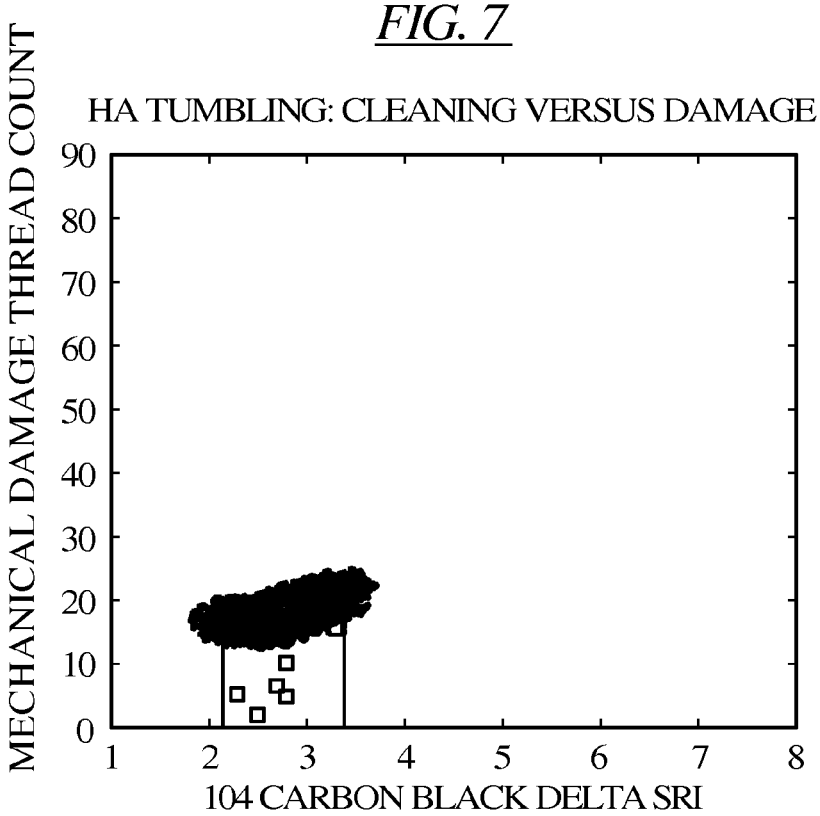
FIG. 7 illustrates experimental results of the cleaning results versus mechanical damage in a washing machine embodying the principles of the present invention.

Experimental test results illustrating the enhanced cleaning action, and reduced mechanical damage, of the present invention are depicted in FIGS. 6 and 7, with performance comparison to a typical fixed oscillation profile. Testing involved placing a test load in a horizontal axis washing machine, saturating the load with water and oscillating the wash chamber for a predetermined period of time. In the random oscillation profile samples, whose results are depicted by boxes, wash chamber oscillation was time varied between 0.135 and 2 seconds. In the fixed oscillation profile samples, whose results are depicted by dots, the wash chamber oscillation occurred in accordance with the profile of FIG. 1.

Two measurements were recorded in these tests:

Measurement 1) Thread count of damaged threads in the clothes load.

Measurement 2) Amount of a particular "dirt" remaining from the amount that was placed on the test clothes items.

The results of Test 1, in which the "dirt" comprised a common amount of clay on fabric samples, are depicted in FIG. 6.

The results of Test 2, in which the "dirt" comprised a common amount of carbon black on fabric samples, are depicted in FIG. 7.

In both tests, the mechanical damage to the fabric load was significantly reduced, while the cleaning action was generally as good or better in the random oscillation machine versus the fixed oscillation machine.

In accordance with methods and apparatuses consistent with the present invention, the mechanical action inside the automatic washer 30, 30' is enhanced in some embodiments by using alternating rotations through a fixed angle, with short pauses between each reversal, and with rotational speeds that vary periodically. The speed may vary from an average speed by a randomly changing amount or by an amount that varies according to some predetermined pattern.

As a specific illustrative example, meant only as an example and not to limit the scope of the invention is as follows. The wash chamber is alternately rotated clockwise and counter-clockwise through an angle of 120°. Following each 120° rotation, the rotation stops and pauses for 0.1 seconds. A reverse rotation of 120° then follows and another 0.1 second pause and the process is repeated. The speed of rotation, in revolutions per minute (RPM) is varied, for example by selecting an "average" or base speed of 70 RPM and varying that speed, by a random amount in the range of ±15 RPM, every 0.2 seconds.

In other embodiments an angle different than 120° can be selected, a different period of time for the pauses can be selected, a different "base" speed of rotation can be selected, a different range of speed variation from the base can be selected, and a different period of time for changing the speed can be selected or the speed could be changed upon the occurrence of an event, such as the reversal of rotation. The speed of rotation could also be varied according to a predetermined pattern rather than randomly. The rotations could be reversed following a given time period rather than a predetermined angle. The various times and angles can either be fixed for the entire wash cycle or can be varied periodically.

Further, one of skill in the art will appreciate that the present invention can be implemented in washing machines having a non-horizontal axis, wherein the wash basket, or protrusions extending inwardly therefrom are used to impart mechanical energy into the clothes load, rather than a separately rotating or oscillating agitator, impeller or other rotor.

While the above-described embodiments of the present invention are presented in terms of symmetric on/pause/on/pause oscillation patterns, the present invention is not limited thereto. The present invention can be implemented with asymmetric oscillation patterns as well. For example, the present invention can be implemented with "random" clockwise and counter-clockwise oscillations with constant motor off times, with "random" clockwise and counter-clockwise oscillations with "random" motor off times, or with constant clockwise and counter-clockwise oscillations with "random" motor off times.

Figures 8, 9, 10:
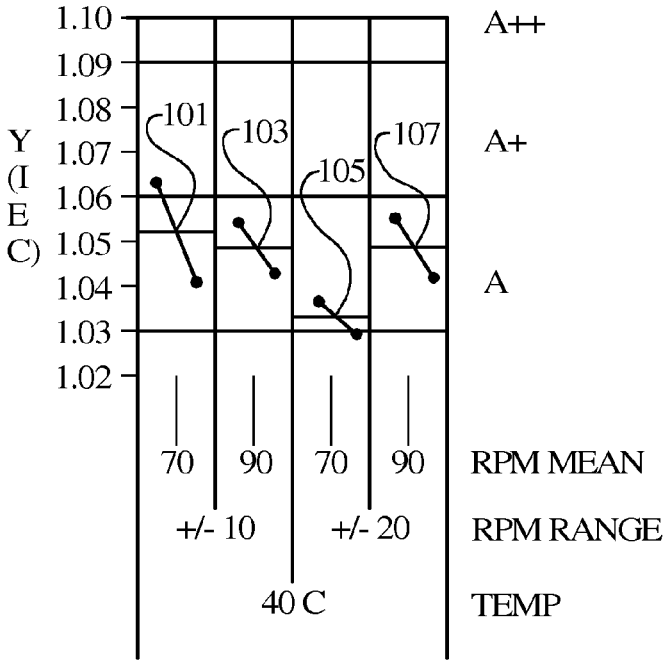
FIG. 8 depicts a table of symmetrical oscillation speeds and rpm ranges.
FIG. 9 depicts a table of asymmetrical oscillation speeds and rpm ranges.
FIG. 10 illustrates wash performance results according to the embodiment of FIG. 9.

As shown for example in FIG. 8, "random" clockwise (CW) and counter-clockwise (CCW) oscillations vary within a selected speed or rpm (revolutions per minute) range around a selected rpm mean. As shown, the selected rpm mean is 70 rpm with a +/−20 RPM range for each of the CW and CCW strokes within which "random" rpm strokes may be selected. As may be appreciated, the range may extend above or below +/−20 RPM, or have a mean different than 70 rpm CW or CCW, while remaining within the scope of the invention. Furthermore, the rpm values may be varied in a bi-modal fashion while remaining within the scope of the invention.

As further shown for example in FIG. 8, the On Time and Off Time may be varied in a "random" manner within a selected range of between 0.3-0.5 seconds On Time CW and CCW, and between 0-0.3 seconds Off Time. As may be appreciated, the range may extend above or below 0.3-0.5 seconds On Time while remaining within the scope of the invention, and the Off Time may continue beyond 0.3 seconds while remaining within the scope of the invention.

The preferred values within the foregoing ranges, or outside the foregoing ranges, and the ranges themselves may be generated in a "random" manner as desired, guided by a design of experiments for a specific automatic washer type.

An alternative embodiment is shown in FIG. 9, wherein the CCW RPM mean is 70, with an RPM range around the mean of +/−10, and a CW RPM mean of 90 with an RPM range around the mean of +/−20. This example illustrates that "random" generation need not be the same within the same ranges and around the same mean RPM for each of the CCW and CW directions. As further shown for example in FIG. 9, the Off Time for example need not be the same for the CCW direction as in the CW direction, in fact the Off Time in this example is a selected constant time of 0.05 seconds.

Wash performance according to this invention is shown in FIG. 10. The International Electrotechnical Commission (IEC) standard for cleaning uses A, B, C, etc. to signify a best to worse cleaning, respectively. The numeric values associated with an IEC rating system is determined by recording the light spectroscopy values of washed stain swatches. These values are then divided by the values obtained in a head-to-head industry cleaning standard washer. The resulting ratio is the IEC cleaning standard, which breaks down as follows. IEC A rating occurs when the swatches achieve an average score of 1.03 and above. An IEC B rating occurs when the swatches achieve an average score between 1.00 and 1.03. An IEC C rating occurs when the swatches achieve an average score between 0.97 and 1.00.

As can be seen in FIG. 10, by tuning and manipulating the "random" agitation profile, the desi horizontal, or X axis, in ascending order of RPM mean first and RPM range second. The IEC ratings are arranged along the Y or vertical axes.

Sampling was done by running a number of wash loads at the selected RPM means and ranges, and the results vary for each. The varying results are shown in the form of a sloped line, from high to low score, with a horizontal line depicting the mean. Specifically, as shown in FIG. 10, the wash performance results 101 range from approximately 1.06 to 1.04 for an RPM mean of 70 and an RPM range of ±10; results 103 range from approximately 1.05 to 1.04 for an RPM mean of 90 and an RPM range of ±10; results 105 range from approximately 1.04 to 1.03 for an RPM mean of 70 and an RPM range of ±20; and results 107 range from approximately 1.05 to 1.04 for an RPM mean of 90 and an RPM range of ±20.

As shown by a horizontal line in each instance, mean wash results range from approximately 1.03 to 1.05, within the IEC A rating range.

Further tests were performed as shown in FIG. 11. In a first pair of tests, described as Full Random A and Full Random B, testing was performed using the "random" parameters. In a second pair of tests, described as Degree Random A and Degree Random B, testing was performed using "random" parameters, each of which strokes maintained a constant angle of swing or stroke. In a third test, described as Ratchet Random, testing was performed using "random" parameters, a constant stroke and a "ratchet" speed profile.

For both the Full Random and the Degree Random profiles, the values within the ranges specified were determined using a uniform random generator. The Ratchet Random profile is unique in that the RPM values changed within its range specified every 0.3 seconds no matter the drum direction. The amount in which the RPM value changed was determined using a uniform random generator.

One of skill in the art will appreciate that the present invention can be implemented in washing machines having a non-horizontal axis, wherein the wash basket, or protrusions or rotors extending inwardly therefrom are used to impart mechanical energy into the clothes load, rather than a separately rotating or oscillating agitator, impeller or other rotor.

The foregoing description of an implementation of the invention has been presented for purposes of illustration and description. It is not exhaustive and does not limit the invention to the precise form disclosed. Modifications and variations are possible in light of the above teachings or may be acquired from practicing the invention. The scope of the invention is defined by the claims and their equivalents.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A method of washing items in an automatic washer having a wash chamber rotatable about a central axis, the method comprising the steps of:

loading items into the wash chamber;

supplying wash liquid into the wash chamber;

oscillating the wash chamber by rotating the wash chamber about the central axis in a first rotational direction through an angular extent comprising a first stroke angle and then rotating the wash chamber about the central axis in a second rotational direction during at least one first oscillation period; and oscillating the wash chamber by rotating the wash chamber about the central axis in the first rotational direction through an angular extent comprising a second stroke angle and then rotating the wash chamber about the central axis in the second rotational direction during at least one subsequent oscillation period, the first and second stroke angles varying from each other.

2. The method of claim 1, wherein the wash chamber oscillates for a plurality of periods, each period having at least one clockwise rotation and at least one counter-clockwise rotation, a stroke angle of each of the rotations selected for each period.

3. The method of claim 2, wherein said stroke angle-varying oscillations vary each sequential period.

4. The method of claim 2, wherein said stroke angle-varying oscillations vary bi-modally after a plurality of sequential periods.

5. The method of claim 2, wherein the stroke angles for each of the periods are randomly selected.

6. The method of claim 2, wherein the stroke angles for each of the periods are preselected.

7. The method of claim 2, wherein the oscillations are symmetric.

8. The method of claim 2, wherein each oscillation of the wash chamber is followed by a pause.

9. The method of claim 8, wherein said pauses vary each sequential period.

10. The method of claim 8, wherein the time durations for each of the pauses are randomly selected.

11. The method of claim 8, wherein the pauses are symmetric.

* * * * *